US010221045B2

(12) United States Patent
Hall et al.

(10) Patent No.: US 10,221,045 B2
(45) Date of Patent: Mar. 5, 2019

(54) ELEVATOR CAR WITH DOOR SYSTEM

(71) Applicants: David R. Hall, Provo, UT (US); Jackson Priddis, Orem, UT (US); Andrew Priddis, Mapleton, UT (US); Eimi Priddis, Mapleton, UT (US)

(72) Inventors: David R. Hall, Provo, UT (US); Jackson Priddis, Orem, UT (US); Andrew Priddis, Mapleton, UT (US); Eimi Priddis, Mapleton, UT (US)

(73) Assignee: Hall Labs LLC, Provo, UT (US)

( * ) Notice: Subject to any disclaimer, the term of this patent is extended or adjusted under 35 U.S.C. 154(b) by 0 days.

(21) Appl. No.: 15/237,775

(22) Filed: Aug. 16, 2016

(65) Prior Publication Data

US 2018/0050887 A1 Feb. 22, 2018

(51) Int. Cl.
*B66B 11/02* (2006.01)
*B66B 13/30* (2006.01)

(52) U.S. Cl.
CPC ..... *B66B 13/303* (2013.01); *B66B 11/0206* (2013.01); *B66B 11/0226* (2013.01); *B66B 13/30* (2013.01); *B66B 2201/4646* (2013.01)

(58) Field of Classification Search
CPC ..... B66B 13/30; B66B 13/303; B66B 9/02; E06B 2009/543; E06B 2009/546
USPC ..... 160/36, 37, 352
See application file for complete search history.

(56) References Cited

U.S. PATENT DOCUMENTS

| | | | | | |
|---|---|---|---|---|---|
| 756,091 | A * | 3/1904 | Altick | E04B 1/344 | 160/183 |
| 4,279,454 | A * | 7/1981 | Koiso | E06B 9/115 | 160/196.1 |
| 5,464,072 | A * | 11/1995 | Muller | B66B 9/02 | 182/12 |
| 2007/0199771 | A1* | 8/2007 | Spiess | B66B 13/08 | 187/332 |
| 2008/0121349 | A1* | 5/2008 | De La Cruz | B60J 11/02 | 160/23.1 |
| 2015/0266700 | A1* | 9/2015 | Salmikuukka | B66B 1/467 | 187/380 |
| 2016/0265275 | A1* | 9/2016 | Rosell Rosell | A47K 3/38 | |
| 2017/0334682 | A1* | 11/2017 | Hanninen | B66B 9/00 | |

FOREIGN PATENT DOCUMENTS

WO WO-2005070807 A2 * 8/2005 ..... B65B 13/185

* cited by examiner

*Primary Examiner* — Minh Truong

(57) ABSTRACT

The invention is an elevator car, with a door system, for with a bottom-driven elevator, where it does not play a structural role in lifting, but provides aesthetics and safety to the passengers. The elevator car comprises lightweight materials. The car comprises a frame and a door system. The door system comprises at least one elevator door and at least one pulley system. The pulley system is attached to the frame and the elevator door is attached to the pulley system, such that the elevator door rotates horizontally around the frame when the pulley system is engaged. The elevator door comprises a pliable material, such as ballistic nylon. The elevator car can have one, two, three, or four door openings, including two adjacent door openings. Finally, the system may also include at least one light curtain that transmits signals to an elevator control system.

20 Claims, 17 Drawing Sheets

ELEVATOR CAR WITH DOOR SYSTEM

TECHNICAL FIELD

This invention relates generally to the field of elevators, and more specifically to elevator cars and doors.

BACKGROUND

Elevators generally operate by means of a pulley-type system. Usually, a cable is attached to the top of an elevator car, and a counterweight is attached to the free end of the cable. The elevator car moves up and down within an elevator shaft when the cable is engaged by a motor. Though this basic system has been used for decades, there are disadvantages inherent in the pulley system method for lifting an elevator. First, the distance that an elevator can travel is limited by the length of the cable. Second, and even more importantly, the method does not maximize efficiency or cost of materials, which is desirable in the construction of green and sustainable buildings.

When an elevator is lifted from the top by means of a cable, the elevator car plays an important structural role in the lifting. The car must be built for strength and stability, so that the elevator car floor is securely attached to the elevator car ceiling, where the cable is attached. On the other hand, if an elevator were lifted from the bottom, the structure of the elevator car would be unimportant. Lighter and economical materials could be used to form the elevator car because the top portion of the car would not need to bear weight. In turn, the motor would not require as much power to lift the elevator. The machine room where the motor is stored in the case of traditional elevators could be eliminated.

Because devices, such as rack and pinion devices or rack and chain devices, have become available for lifting elevators from the bottom, what is needed is an elevator car designed to be constructed from light and economical materials to be utilized with the bottom-driven elevators. One of the specific challenges in creating such a car would be the door. Therefore, what is needed, more specifically, is a door that can function in tandem with such an elevator car. The door and car would need to be lightweight, yet retain the essential function of prior art elevator cars and doors in preventing passengers from falling out of the elevator or reaching into the elevator shaft. The door would also need to open when the elevator arrived at a desired destination, and close before the elevator commenced motion. The door would need some sort of motion sensor system to prevent the door from closing on people or items passing through it. Finally, a car that would allow a door to open on more than one side would allow greater versatility and functionality of the elevator.

SUMMARY OF THE INVENTION

The disclosed invention has been developed in response to the present state of the art and, in particular, in response to the problems and needs in the art that have not yet been fully solved by currently available components and methods. Accordingly, efficient structural components and methods have been developed to allow an elevator car with a door system to be constructed from lightweight materials.

Consistent with the foregoing, an elevator car is disclosed. The elevator car comprises a frame and a door system. The frame comprises interconnected vertical supports and horizontal supports, which, in one embodiment, comprise one of a group of lightweight metals consisting of aluminum, magnesium, titanium, beryllium alloys, or combinations thereof. The vertical supports define car walls, and the horizontal supports define a car floor and a car ceiling. In one embodiment, the frame comprises a rectangular prismatic configuration.

The door system comprises at least one pulley system, which is attached to the horizontal supports, extending around the perimeter of the car, and at least one elevator door. The at least one elevator door is attached to the at least one pulley system, such that the at least one elevator door rotates horizontally around the frame when the at least one pulley system is engaged. In some embodiments, at least one pulley system is attached to horizontal supports on the top of the frame and at least one pulley system is attached to horizontal supports on the bottom of the frame. The at least one elevator door comprises a pliable material. In one embodiment, the pliable material comprises one of a group consisting of ballistic nylon, another synthetic fabric, and vinyl. In another embodiment, the pliable material comprises one of a group consisting of woven, non-woven, knitted, and netting fabrics.

In different embodiments, the at least one elevator door opens to expose a door opening on one side, two sides, three sides, or four sides of the elevator car. In one embodiment, the at least one elevator door opens to expose door openings on two adjacent sides of the elevator car. In some embodiments, the at least one elevator door extends over two sides of the elevator car.

In some embodiments, the elevator car further comprises at least one of a group consisting of a ceiling, a floor, and at least one wall. In a preferred embodiment, the ceiling, the floor, and the at least one wall comprise plastic. In another embodiment, the ceiling, the floor, and the at least one wall comprise one of a group of lightweight metals consisting of aluminum, magnesium, titanium, beryllium alloys, or combinations thereof. In still another embodiment, the ceiling, the floor, and the at least one wall comprise optically transparent or semi-optically transparent materials.

In one embodiment, the elevator door system comprises at least one light curtain. The at least one light curtain transmits signals to an elevator control system. In one embodiment, the at least one pulley system comprises a motor, and the motor receives signals from the elevator control system. In one embodiment, the elevator control system is a voice control system.

BRIEF DESCRIPTION OF THE DRAWINGS

A more particular description of the invention briefly described above is made below by reference to specific embodiments depicted in drawings included with this application, in which.

DETAILED DESCRIPTION

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

When an elevator is driven from the bottom, for example, with a rack and chain lifting device, with a rack and pinion device, or with a hydraulic lift, an elevator car does not play a structural role in lifting, as with prior art elevators driven from the top by pulley systems. Rather, the elevator car acts only as a façade—it is unnecessary structurally—and it provides only aesthetics and safety, preventing passengers from injuries that might occur if limbs protrude into the elevator shaft and helping passengers feel secure. Therefore, the elevator car can be constructed from lighter and economical materials, improving the overall cost and efficiency of constructing the elevator.

Figure 1:
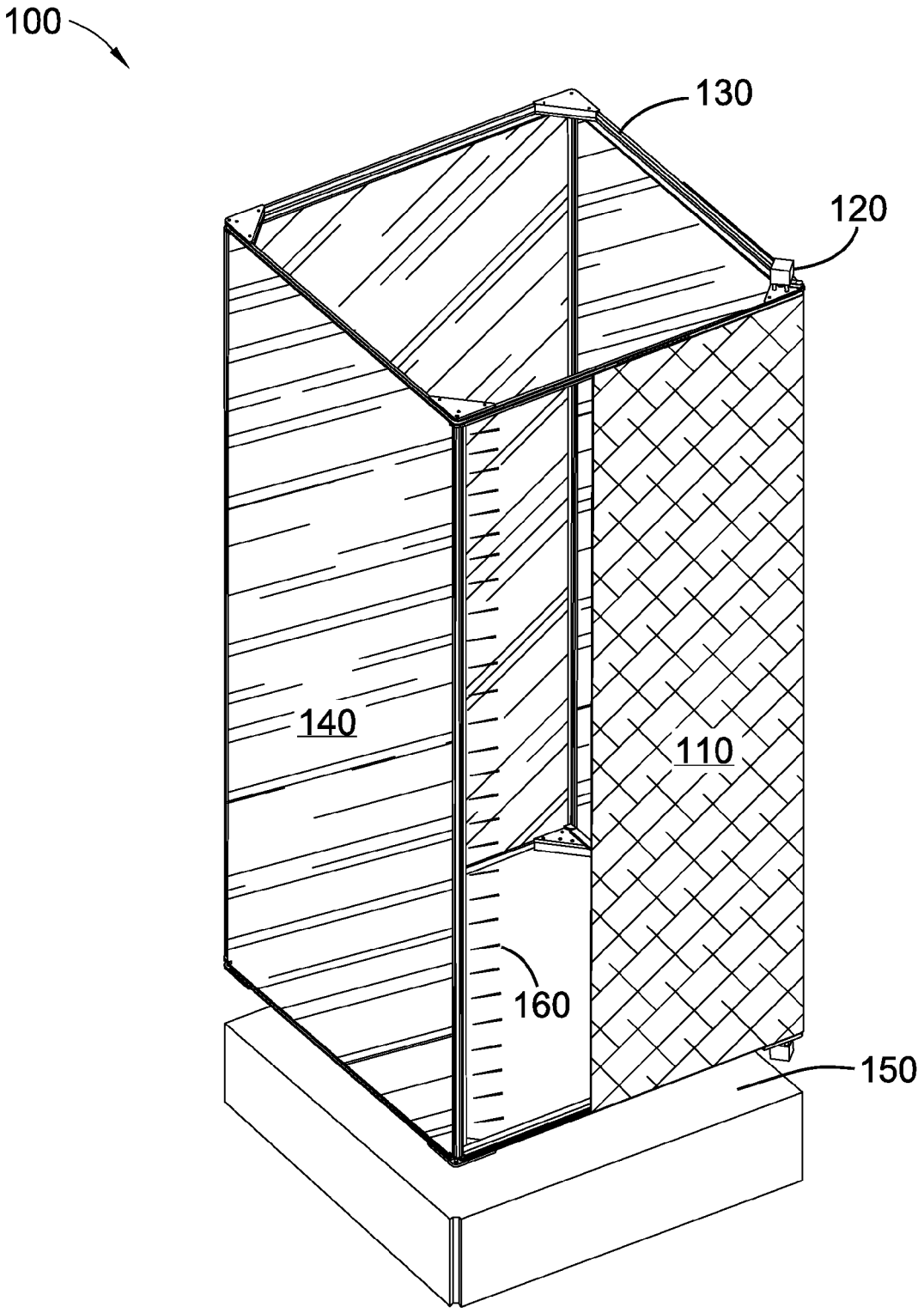
FIG. 1 depicts a perspective view of one embodiment of an elevator car.

FIG. 1 depicts one embodiment of such an elevator car 100. The elevator car comprises a frame 130, comprising interconnected vertical supports and horizontal supports. The elevator car 100 further comprises a door system, comprising at least one pulley system 120 attached to the horizontal supports and extending around the perimeter of the car, and at least one elevator door 110 comprising a pliable material. The at least one elevator door 110 is attached to the at least one pulley system 120, such that the at least one elevator door 110 rotates horizontally around the frame 130 when the at least one pulley system 120 is engaged. In some embodiments, the elevator car 100 further comprises at least one of a group consisting of a ceiling, not shown; a floor, not shown; and at least one wall 140. In a preferred embodiment, the elevator car 100 has no floor. Rather, the floorless elevator car 100 is secured with connectors to an elevator platform 150, driven from below with, for example, a rack and chain lifting device. In some embodiments, the elevator car further comprises at least one light curtain 160.

Figure 2:
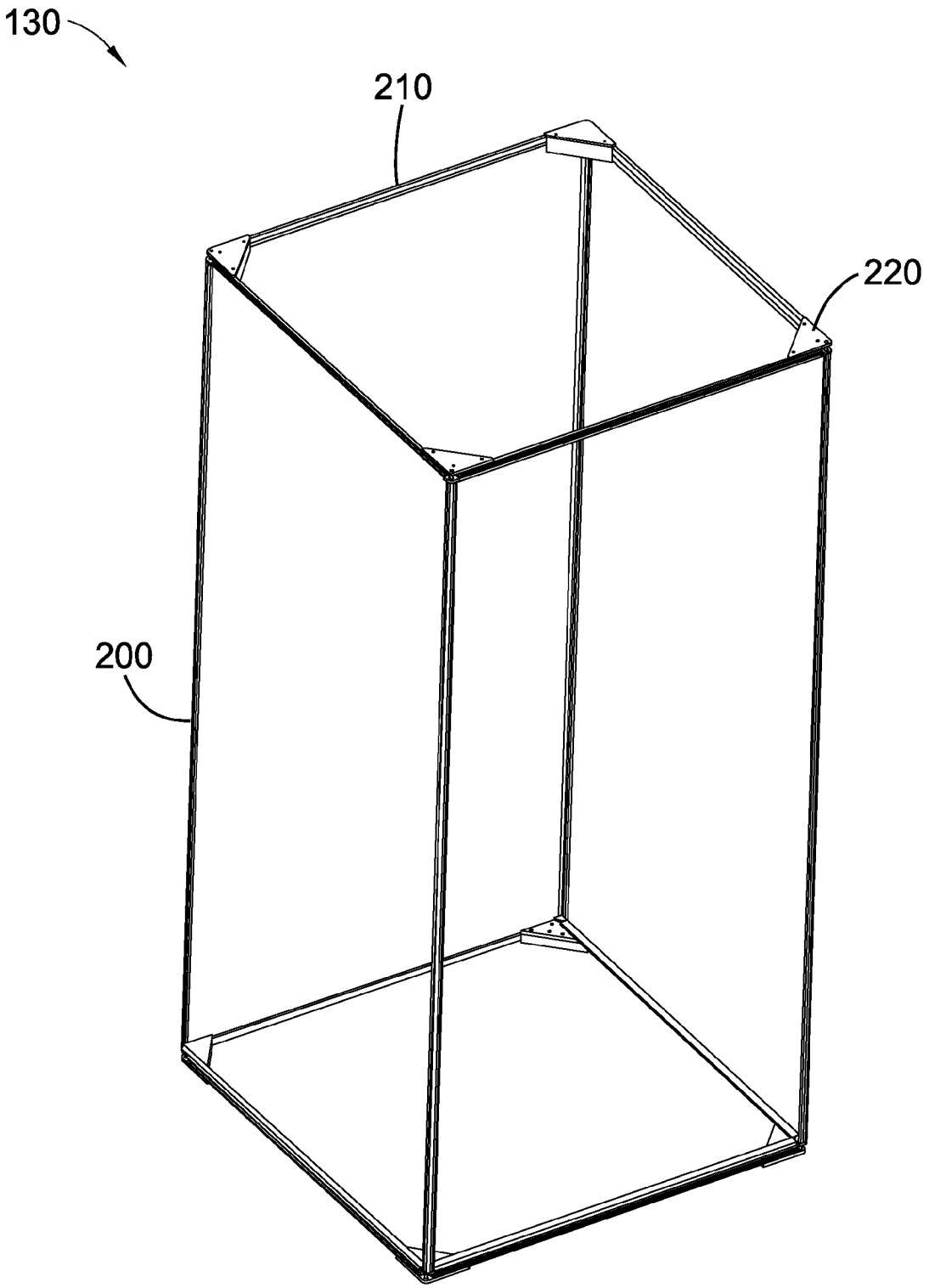
FIG. 2 depicts a perspective view of one embodiment of a frame.

FIG. 2 depicts one embodiment of a frame 130. The frame 130 comprises interconnected vertical supports 200 and horizontal supports 210. The vertical supports 200 define car walls, and the horizontal supports 210 define a car floor and a car ceiling. The vertical supports 200 and the horizontal supports 210 are connected together using connectors. In one embodiment, they are connected together using metal plates 220. The frame 130 comprises lightweight materials. In one embodiment, the frame 130 comprises one of a group of lightweight metals consisting of aluminum, magnesium, titanium, beryllium alloys, or combinations thereof. In a preferred embodiment, the frame 130 comprises a rectangular prismatic configuration.

Figure 3A:
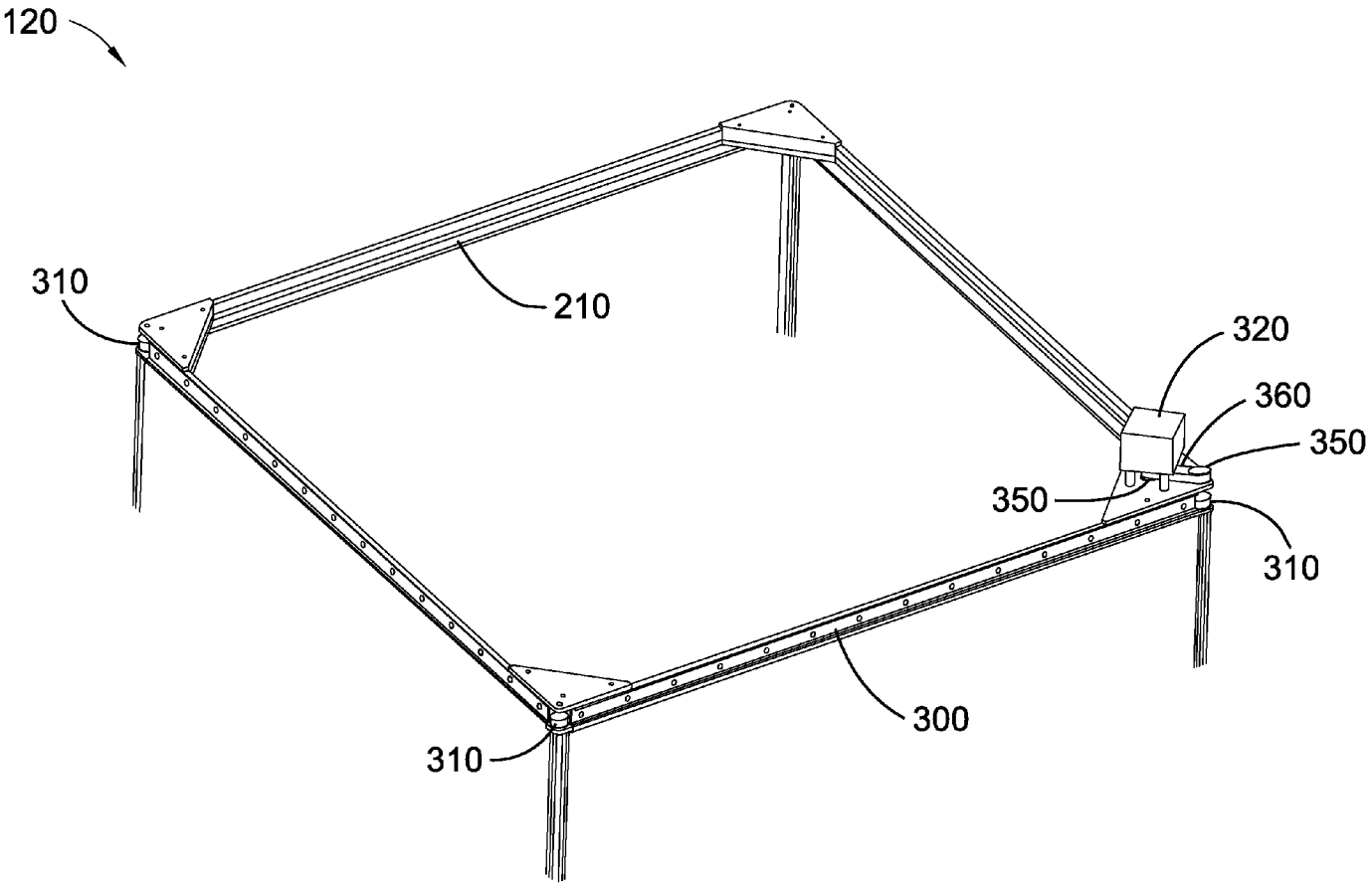
FIG. 3A depicts a close-up view of one embodiment of a pulley system without a belt.
Figure 3B:
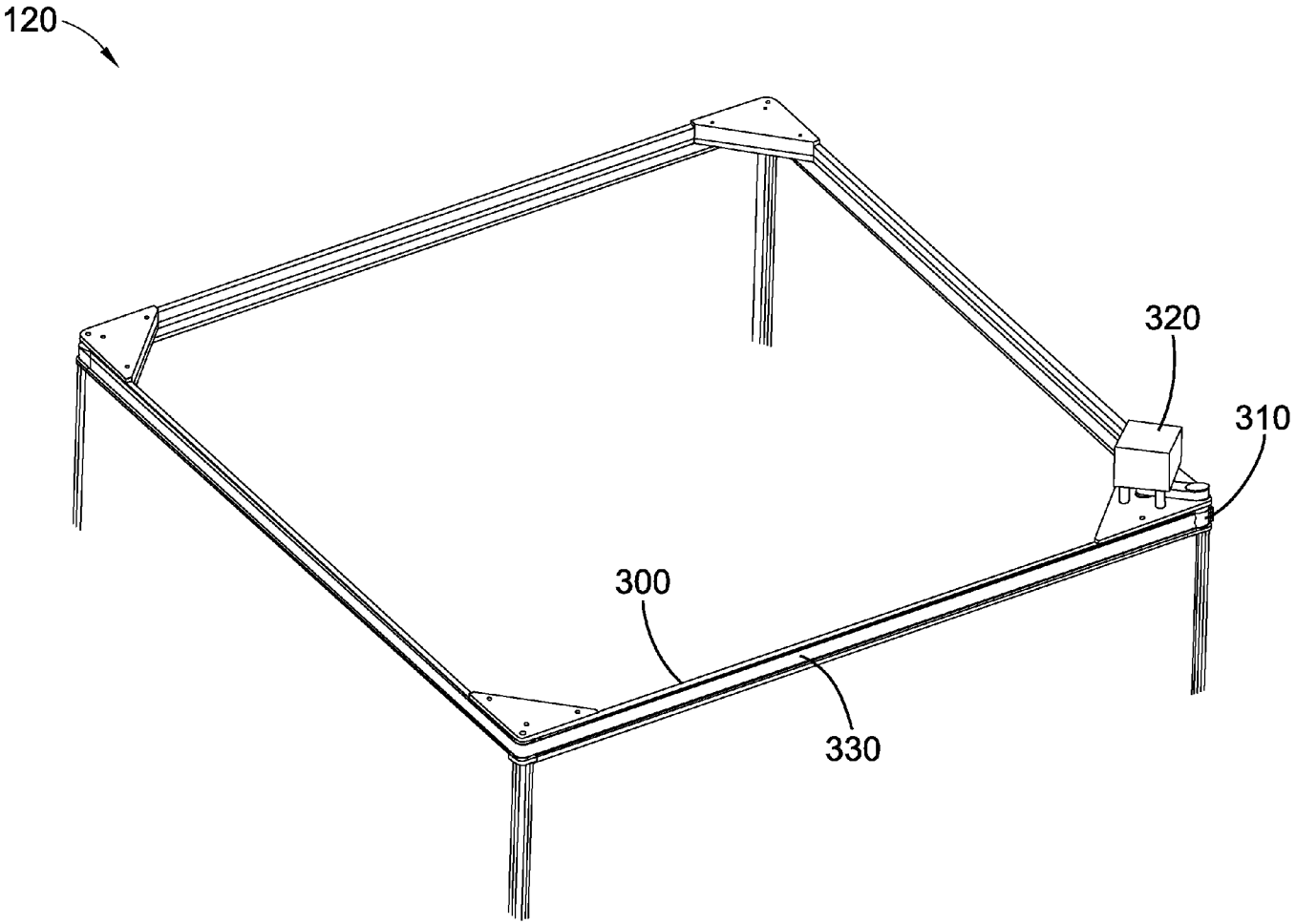
FIG. 3B depicts a close-up view of one embodiment of a pulley system.

FIG. 3A and FIG. 3B depict embodiments of a pulley system 120. The elevator car 100 comprises a door system, and the door system comprises at least one pulley system 120. The at least one pulley system 120 is attached to the horizontal supports 210 of the frame 130 and extends around the perimeter of the elevator car 100. Some embodiments of the door system comprise more than one pulley system 120. In a preferred embodiment, at least one pulley system 120 is attached to horizontal supports 210 on the top of the frame 130 and at least one pulley system 120 is attached to horizontal supports 210 on the bottom of the frame 130. The presence of at least one pulley system 120 on the top and one on the bottom of the frame 130 allows an elevator door to be secured to at least one pulley system 120 on the top and one on the bottom, such that the elevator door is pulled taut and secured in place and does not flap out at the bottom, which increases the safety of the elevator car 100. In some embodiments, two or more pulley systems 120 are secured on top of the frame 130, and two or more pulley systems 120 are secured on the bottom of the frame 130. These embodiments allow the elevator car 100 to comprise more than one elevator door.

FIG. 3A depicts a close-up view of one embodiment of a pulley system 120. Each pulley system 120 comprises a set of tracks 300, at least one pulley 310, a motor 320, and a belt 330. FIG. 3A depicts a pulley system without the belt 330. The set of tracks 300 is attached with connectors to the horizontal supports 210 of the frame 130 of the elevator car 100. The set of tracks 300 extend around the entire perimeter. In a preferred embodiment, at least one set of tracks 300 is attached to horizontal supports 210 on the top of the frame 130 and at least one set of tracks 300 is attached to horizontal supports 210 on the bottom of the frame 130. In one embodiment, the set of tracks 300 comprises a lightweight metal, such as aluminum, magnesium, titanium, beryllium alloys, or combinations thereof. In one embodiment, at least one pulley 310 is secured in a corner formed by the set of tracks 300 in a corner of the frame 130. In a preferred embodiment, a pulley 310 is secured in each corner formed by the set of tracks 300 in each corner of the frame 130. In one embodiment, a motor 320 is secured with a plate 340 atop a corner formed by the set of tracks 300 in a corner of the frame 130. At least one pulley 310 is directly connected to the motor 320, such that the motor 320 drives the pulley 310. In one embodiment, the motor 320 is connected to a main pulley 310 using two secondary pulleys 350. In this embodiment, the motor 320 directly drives one secondary pulley 350. The one secondary pulley 350 is connected with a small belt 360 to a second secondary pulley 350. The second secondary pulley 350 is connected directly to the main pulley 310. Therefore, when the motor 320 is engaged, it drives the main pulley 310. This configuration allows the motor 320 of each pulley system 120 to be placed in a corner, whereas the size and shape of the motor 320 might otherwise prevent this.

FIG. 3B depicts a close-up view of one embodiment of a pulley system 120 with a belt 330. In one embodiment, the belt 330 is wrapped around at least one pulley 310 that is secured in a corner formed by the set of tracks 300 in a corner of the frame 130, and the belt 330 is aligned with the set of tracks 300. In a preferred embodiment, the belt 330 is wrapped around a pulley 310 secured in each corner formed by the set of tracks 300 in each corner of the frame 130, and the belt 330 is aligned with the set of tracks 300. In a preferred embodiment, the belt 330 extends, with the set of tracks 300, around the entire perimeter of the elevator car 100. At least one elevator door is attached to the belt 330, such that the at least one elevator door rotates horizontally around the frame 130 when the at least one pulley system 120 is engaged. More specifically, as the belt 330 revolves around at least one pulley 310, driven by the motor 320, and in line with the set of tracks 300, the at least one elevator door rotates horizontally around the frame 130, such that the elevator door can be opened and closed. In one embodiment, the motor 320 receives signals from an elevator control system. The elevator control system causes the motor 320 to engage automatically to open an elevator door when the elevator stops at a floor of a building and to close an elevator door before the elevator commences moving.

Figure 4:
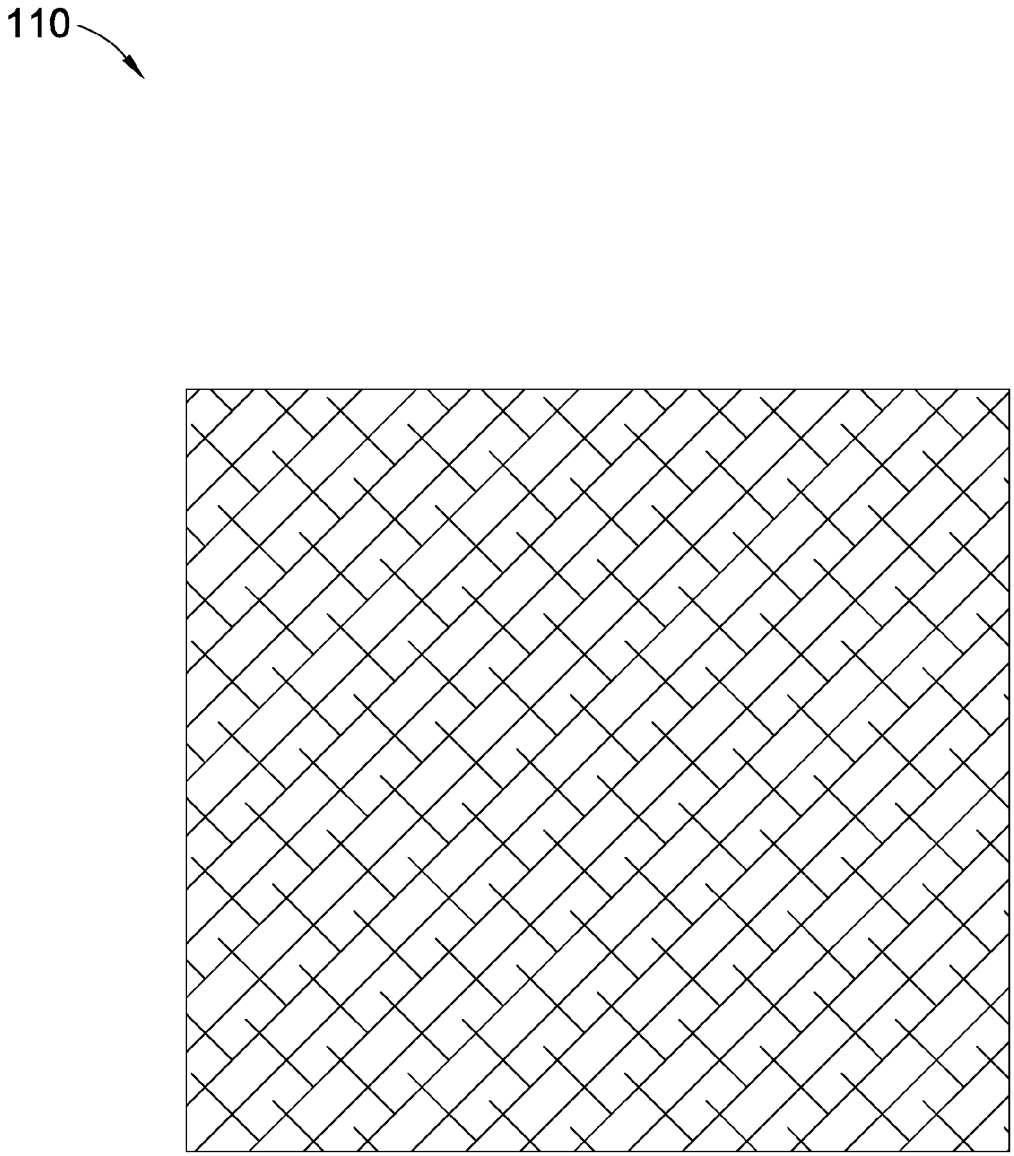
FIG. 4 depicts a perspective view of one embodiment of an elevator door.

FIG. 4 depicts one embodiment of an elevator door 110. The elevator car 100 comprises a door system, which comprises at least one elevator door 110. The at least one elevator door 110 comprises a pliable material. The pliable material must be lightweight. The pliable material must be flexible enough to bend around corners of the frame 130, but stiff enough to provide a sense of security and to protect people from reaching outside of the elevator car. In one embodiment, the pliable material comprises one of a group consisting of ballistic nylon, another synthetic fabric, and vinyl. In a preferred embodiment, the pliable material comprises ballistic nylon. In other embodiments, the pliable material comprises one of a group consisting of woven, non-woven, knitted, and netting fabrics. The elevator door 110 is in the shape and size of at least one side of the elevator car 100. In a preferred embodiment, the elevator door 110 extends over two sides of the elevator car 100. The at least one elevator door 110 is attached to the belt 330 of at least one pulley system 120, such that the at least one elevator door 110 rotates horizontally around the frame 130 when the at least one pulley system 120 is engaged. In this way, the elevator door 110 opens and closes. The use of lightweight material in the elevator door 110 and the manner in which it is opened and closed also allows the elevator door 110 of the elevator car 100 to the full extent of the size of the elevator car 100, which is wider than most prior art elevators. This makes the invented elevator door system more accommodating for the handicapped or for those transporting large items.

Figure 5A:
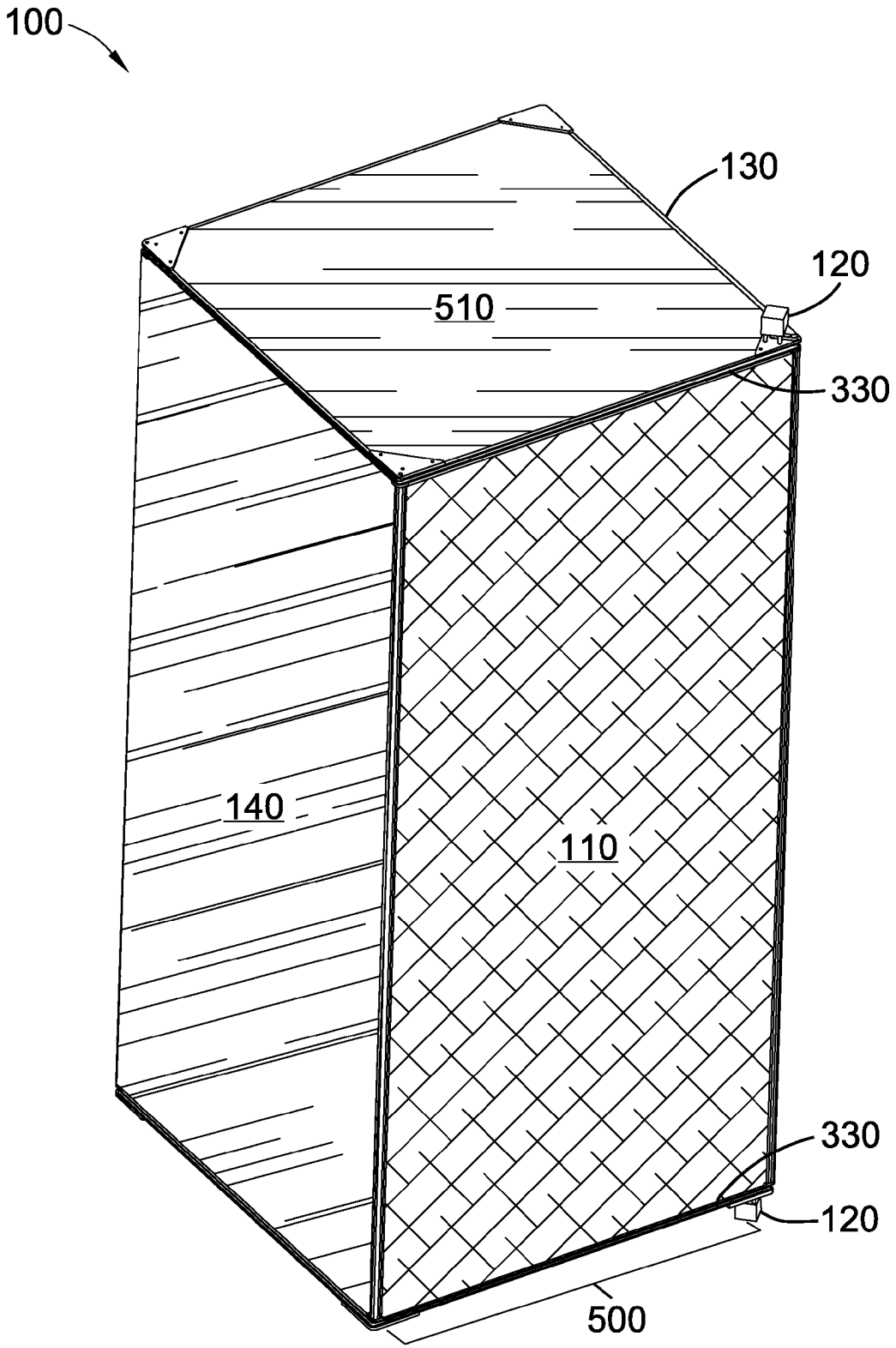
FIG. 5A depicts a perspective view of one embodiment of an elevator car, wherein at least one elevator door opens to expose a door opening on one side of the elevator car.

FIG. 5A depicts one embodiment of an elevator car 100, wherein at least one elevator door 110 opens to expose a door opening 500 on one side of the elevator car 100. A door opening is an area defined as an elevator car wall that is covered by an elevator door 110, but that is otherwise unobstructed when the elevator door 110 is opened, thus allowing ingress to and egress from an elevator. In this embodiment of elevator car 100, the elevator car 100 comprises a frame 130 and a door system, comprising one elevator door 110, in the shape and size of one side of the elevator car 100, and at least one pulley system 120. The elevator door 110 covers the one door opening 500. In a preferred embodiment, there are two pulley systems 120, one on the top and one on the bottom of the frame 130. The elevator door 110 is attached between the two belts 330 of the two pulley systems 120. In this embodiment, the elevator car 100 also comprises three walls 140 and a ceiling 510. The walls 140 enclose the elevator car 100 on each side where a door opening 500 is not. In a preferred embodiment, the elevator car 100 has no floor. Rather, the floorless elevator car 100 is secured with connectors to a separate elevator platform.

Figure 5B:
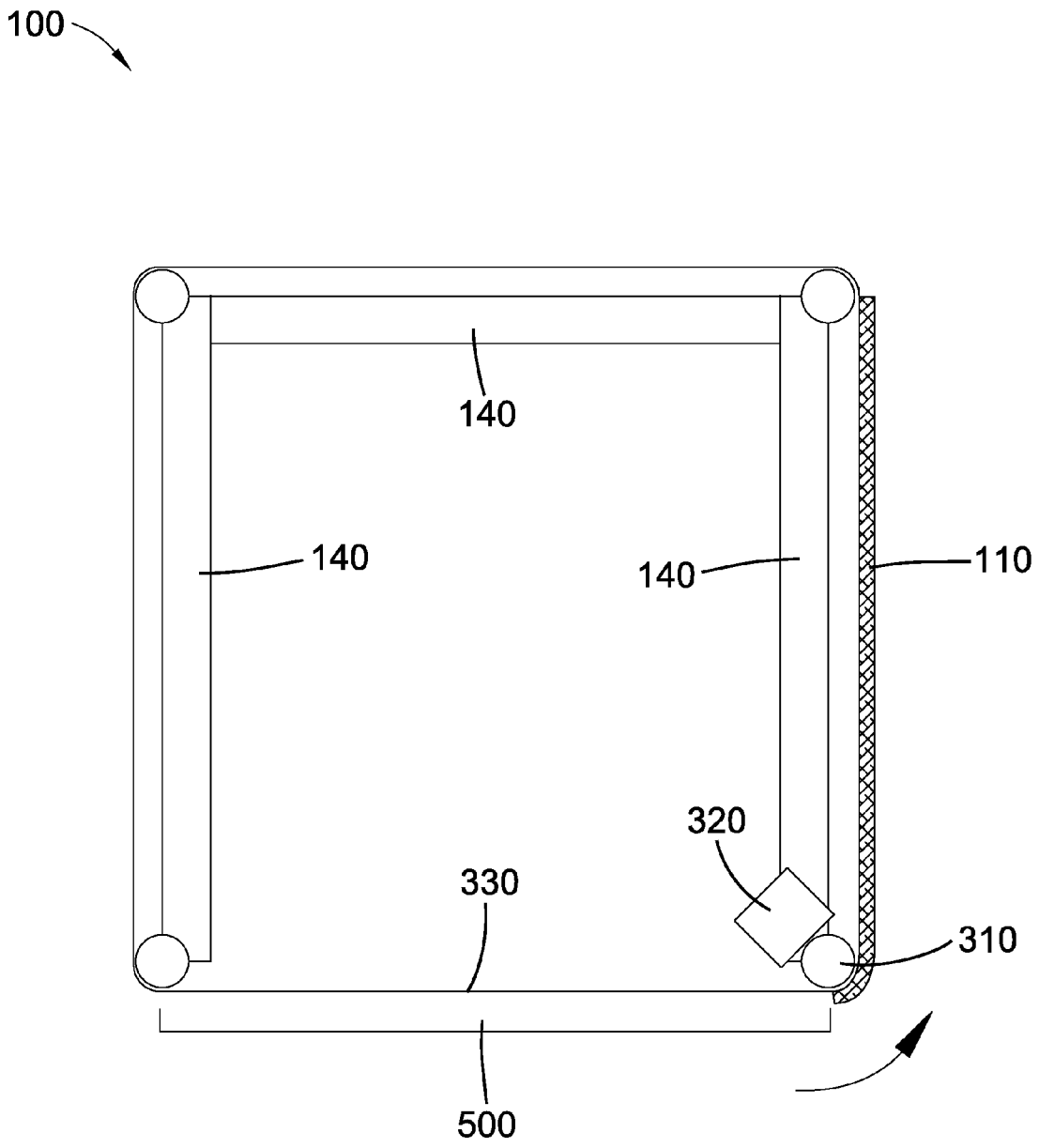
FIG. 5B depicts a top view of the method for opening the at least one elevator door in an embodiment of an elevator car, wherein the at least one elevator door opens to expose a door opening on one side of the elevator car.

FIG. 5B depicts the method for opening the at least one elevator door 110 in an embodiment of an elevator car 100, wherein the at least one elevator door 110 opens to expose a door opening 500 on one side of the elevator car 100. When the motor 320 of the at least one pulley system 120 is engaged, a belt 330 of the at least one pulley system 120 revolves around a pulley 310 of the at least one pulley system 120, along a set of tracks 300, which extend around the perimeter of the elevator car 100. An elevator door 110 that is attached to the belt 330 moves in the direction that the pulley 310 rotates. In one embodiment, as the elevator door 110 moves, the elevator door is not folded or bunched or constricted. The elevator door 110 retains its original shape, stretched loosely but fully, so the elevator door 110 overlaps on the outside an adjacent wall 140 of the elevator car 100. A door opening 500 is exposed, allowing ingress to and egress from the elevator. The elevator door 110 can travel either direction, left or right.

Figure 6A:
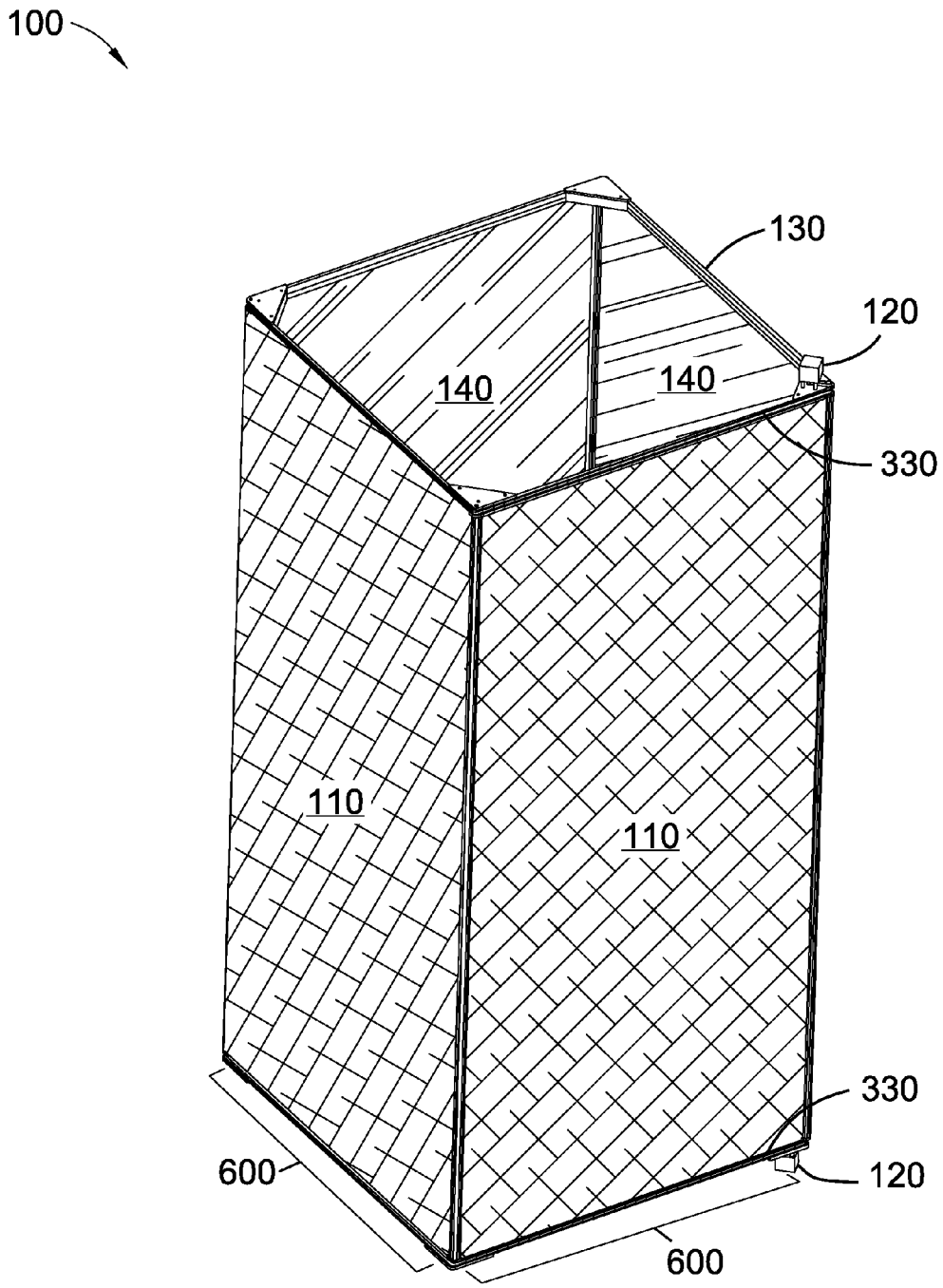
FIG. 6A depicts a perspective view of one embodiment of an elevator car, wherein at least one elevator door opens to expose door openings on two sides of the elevator car.

FIG. 6A depicts one embodiment of an elevator car 100, wherein the at least one elevator door 110 opens to expose door openings 600 on two sides of the elevator car 100. The elevator car 100 comprises a frame 130 and a door system, comprising at least one elevator door 110, and at least one pulley system 120. In a preferred embodiment, the door system comprises one elevator door 110 in the shape and size of two sides of the elevator car 100 and extending over two sides. In another embodiment, there are two elevator doors 110, each in the shape and size of one side of the elevator car 100. The at least one elevator door 110 covers the two door openings 600. In one embodiment, the two door openings 600 are on two adjacent sides of the elevator car 100. A preferred embodiment comprises two pulley systems 120, one on top and one on the bottom of frame 130. The at least one elevator door 110 is attached between the two belts 330 of the two pulley systems 120. Some embodiments of elevator car 100 comprise at least one of a group consisting of a ceiling, a floor, and at least one wall. In a preferred embodiment, the ceiling, the floor, and the at least one wall comprise plastic. In another embodiment, the ceiling, the floor, and the at least one wall comprise one of a group of lightweight metals consisting of aluminum, magnesium, titanium, beryllium alloys, or combinations thereof. In still another embodiment, the ceiling, the floor, and the at least one wall comprise optically transparent or semi-optically transparent materials. In this embodiment with two door openings, the elevator car 100 comprises two walls 140 and a ceiling (which is not shown so that the inside of the elevator car can be seen). The walls 140 enclose the elevator car 100 on each side where a door opening 600 is not. In a preferred embodiment, the elevator car 100 has no floor. Rather, the floorless elevator car 100 is secured with connectors to a separate elevator platform.

Figure 6B:
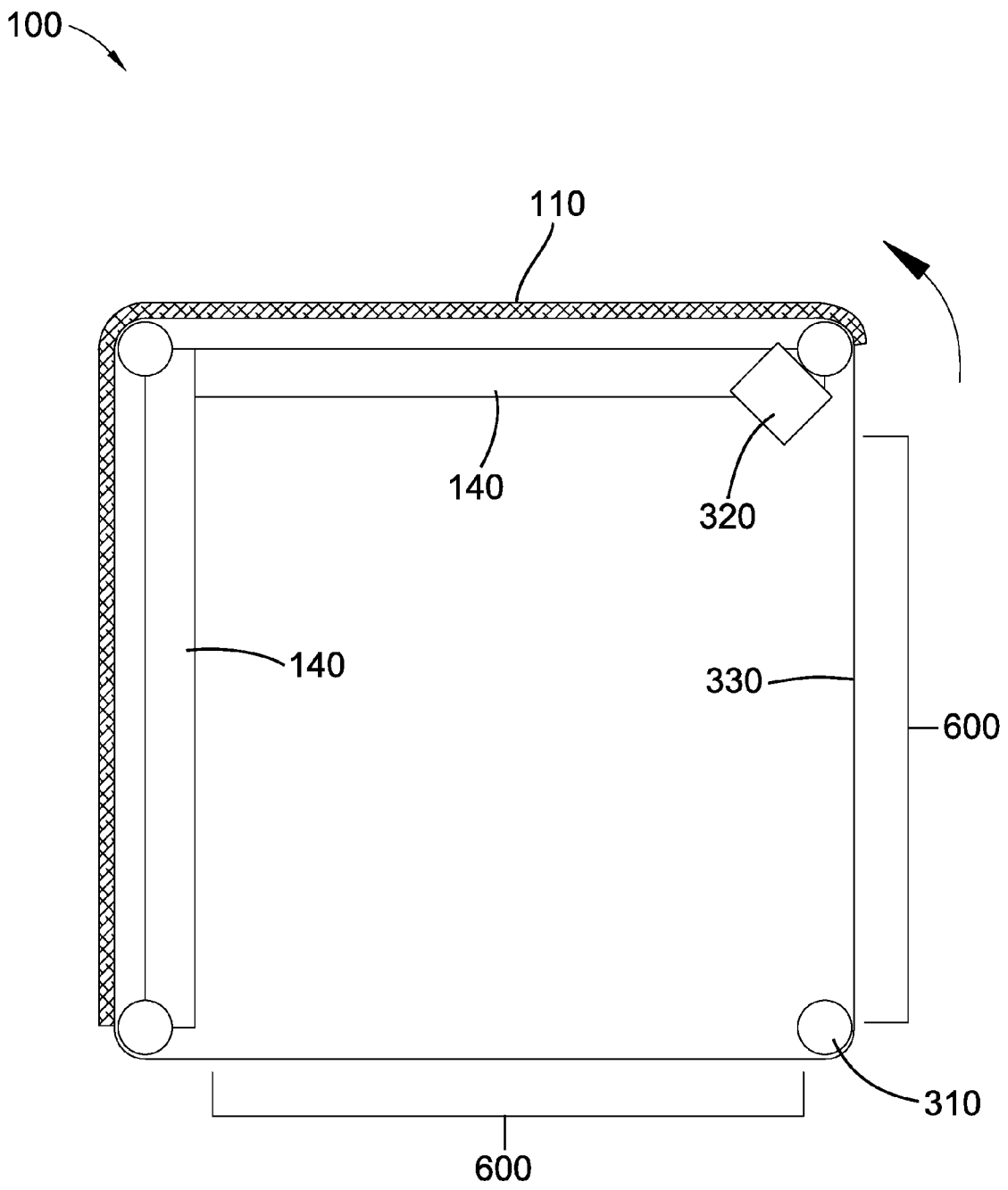
FIG. 6B depicts a top view of the method for opening the at least one elevator door in an embodiment of an elevator car, wherein the elevator door opens to expose door openings on two sides of the elevator car, and wherein the elevator door, in the shape and size of two sides of the elevator car, is rotated until it overlaps two adjacent walls of the elevator car.
Figure 6C:
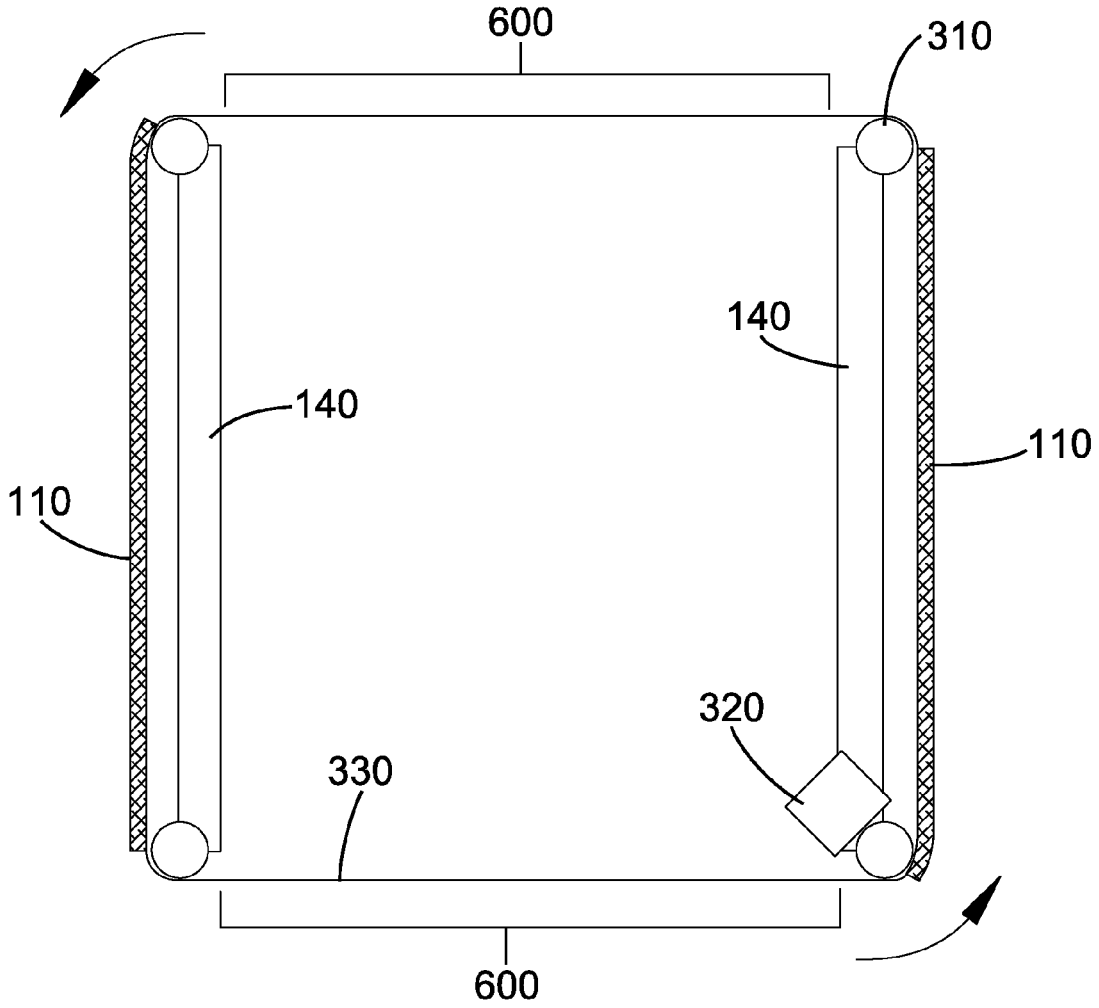
FIG. 6C depicts a top view of the method for opening the at least one elevator door in an embodiment of an elevator car, wherein the elevator door opens to expose door openings on two sides of the elevator car, and wherein two elevator doors, each in the shape and size of one side of the elevator car, are rotated until they overlap two opposite walls of the elevator car.

FIG. 6B and FIG. 6C depict methods for opening the at least one elevator door 110 in an embodiment of an elevator car 100, wherein the at least one elevator door 110 opens to expose door openings 600 on two sides of the elevator car 100. When the motor 320 of at least one pulley system 120 is engaged, a belt 330 of the at least one pulley system 120 revolves around at least one pulley 310 of the at least one pulley system 120, along a set of tracks 300, which extend around the perimeter of the elevator car 100. At least one elevator door 110 that is attached to the belt 330 moves in the direction that the pulley 310 rotates. In one embodiment, as the at least one elevator door 110 moves, the at least one elevator door 110 is not folded or bunched or constricted. The at least one elevator door 110 retains its original shape, stretched loosely but fully, so the at least one elevator door 110 overlaps at least one adjacent wall 140 of the elevator car 100. At least one door opening 600 is exposed, allowing ingress to and egress from the elevator. The elevator door 110 can travel either direction, left or right. FIG. 6B depicts a preferred embodiment, in which the elevator door 110, in the shape and size of two sides of the elevator car 100, is rotated until it overlaps two adjacent walls 140 of the elevator car 100. In this embodiment, two door openings 600 are exposed, allowing ingress to and egress from the elevator. In this embodiment, the at least one elevator door 110 opens to expose door openings 600 on two adjacent sides of the elevator car 100. Two adjacent door openings allow increased flexibility in the use of the elevator. If desired, just one door opening 600 can be exposed. FIG. 6C depicts one embodiment, in which two elevator doors 110, each in the shape and size of one side of the elevator car 100, are rotated until they overlap two opposite walls 140 of the elevator car 100. In this embodiment, two door openings 600 are exposed, allowing ingress to and egress from the elevator. In this embodiment, the two door openings 600 are not adjacent, but rather are opposite each other. In this embodiment, two door openings 600 must be exposed. Just one door opening 600 cannot be exposed.

Figure 7A:
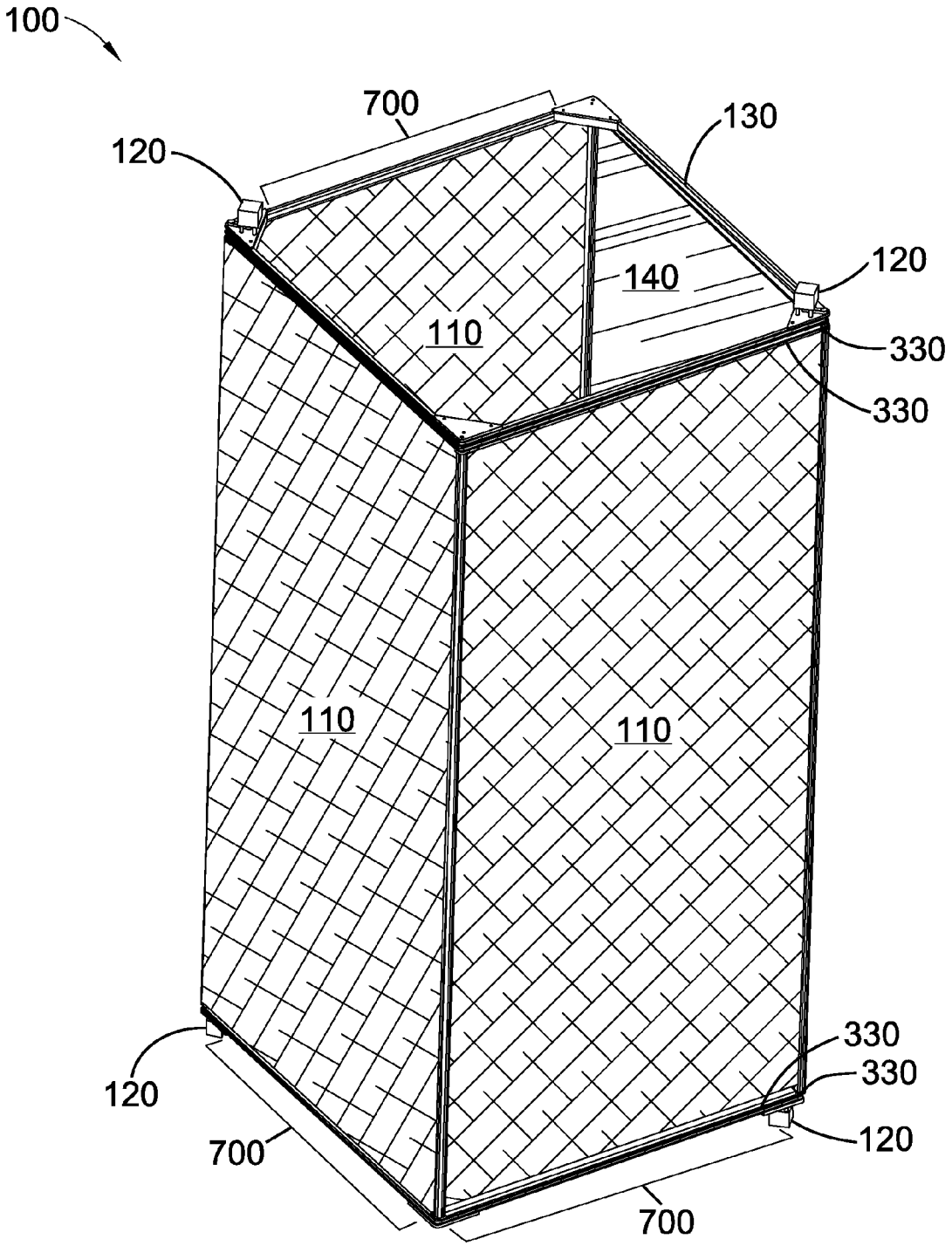
FIG. 7A depicts a perspective view of one embodiment of an elevator car, wherein at least one elevator door opens to expose door openings on three sides of the elevator car.

FIG. 7A depicts one embodiment of an elevator car 100, wherein at least one elevator door 110 opens to expose door openings 700 on three sides of the elevator car 100. The elevator car 100 comprises a frame 130 and a door system, comprising at least one elevator door 110 and at least one pulley system 120. A preferred embodiment comprises two elevator doors 110, each in the shape and size of two sides of the elevator car 100. Another embodiment comprises one elevator door 110 in the shape and size of three sides of the elevator car 100. However, the latter embodiment is not preferred because when the elevator door opened, the elevator shaft would be left exposed on one side. Another embodiment comprises three elevator doors 110 in the shape and size of one side of the elevator car 100. This embodiment is also not preferred because three pulley systems 120 would be required when the same work could be done by only two. The at least one elevator door 110 covers the three door openings 700. In a preferred embodiment, there are two pulley systems 120 attached on top and two pulley systems 120 attached on the bottom of the frame 130. In a preferred embodiment, one elevator door 110, in the shape and size of two sides of the elevator car 100, is attached between belts 330 of a pulley system 120 that is attached on the top and a pulley system 120 that is attached on the bottom of the frame 130, and a second elevator door 110 in the shape and size of two sides of the elevator car 100 is attached between belts 330 of a second pulley system 120 that is attached on the top and a second pulley system 120 that is attached on the bottom of the frame 130. In this embodiment, the elevator car 100 also comprises one wall 140 and a ceiling (which is not shown so that the inside of the elevator car can be seen). The wall 140 encloses the elevator car 100 on the side where a door opening 700 is not. In a preferred embodiment, the elevator car 100 has no floor. Rather, the floorless elevator car 100 is secured with connectors to a separate elevator platform.

Figure 7B:
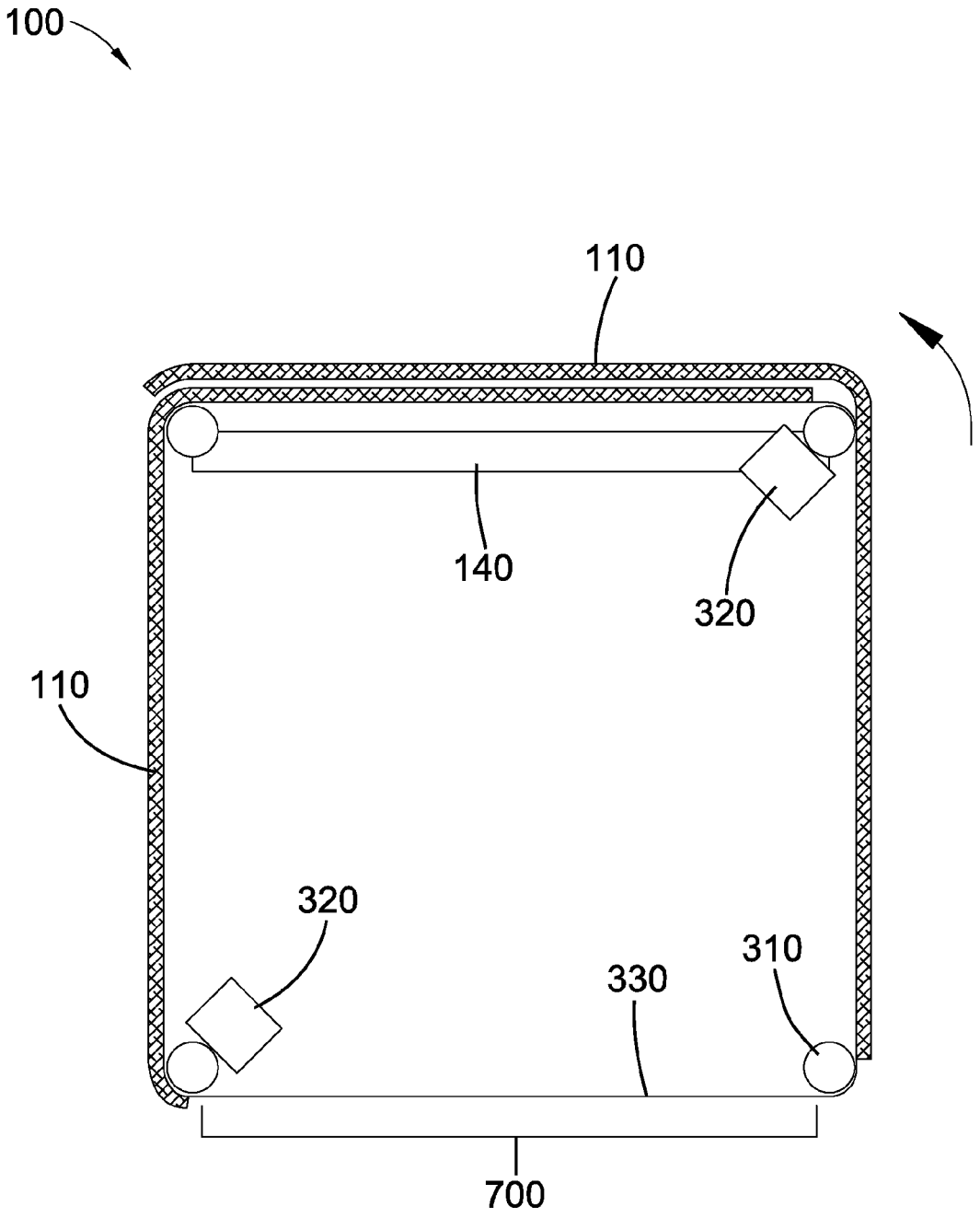
FIG. 7B depicts a top view of one embodiment of an elevator car, wherein at least one elevator door opens to expose door openings on three sides of the elevator, and a front elevator door opening.
Figure 7C:
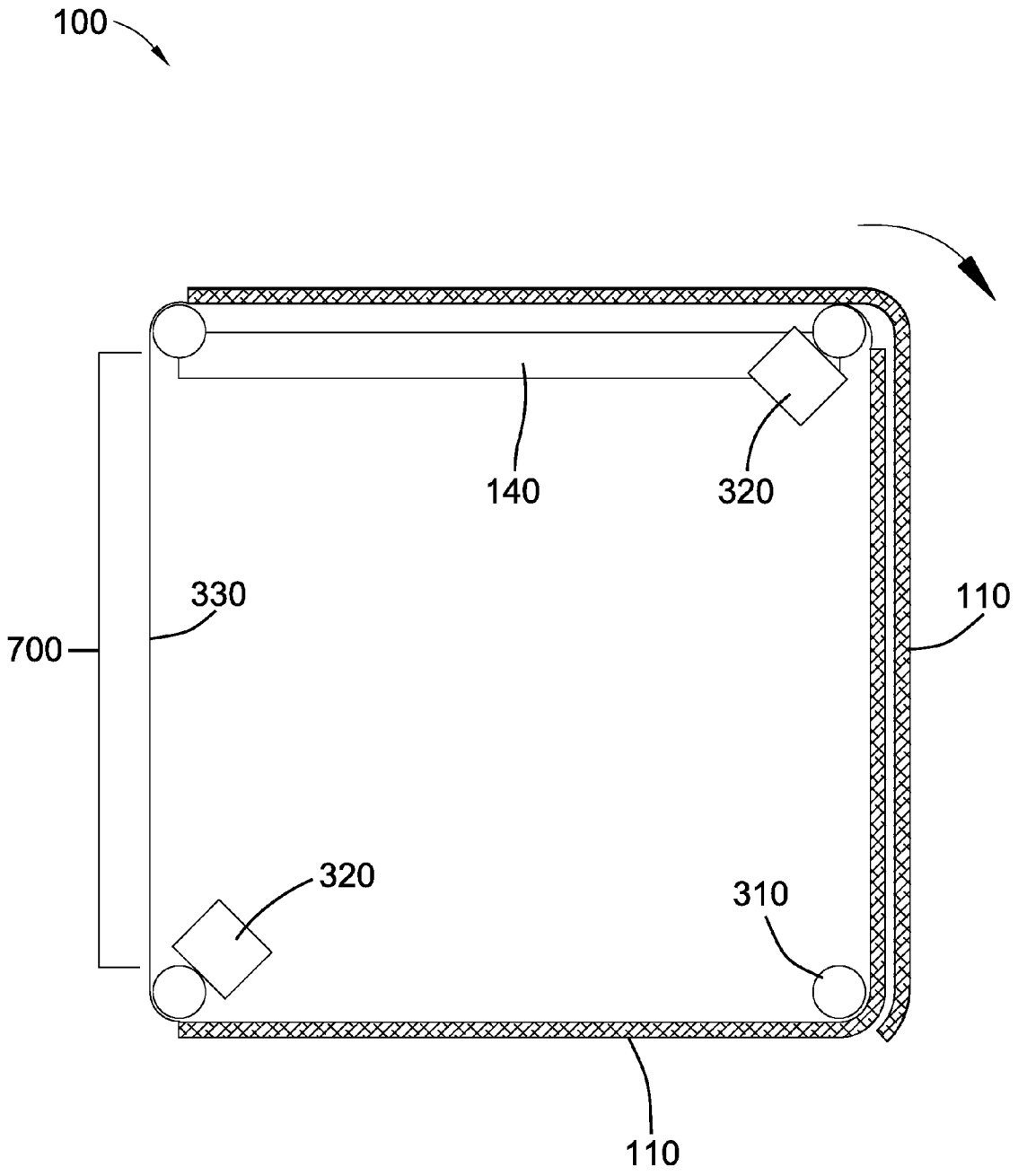
FIG. 7C depicts a top view of one embodiment of an elevator car, wherein at least one elevator door opens to expose door openings on three sides of the elevator, and a left side elevator door opening.
Figure 7D:
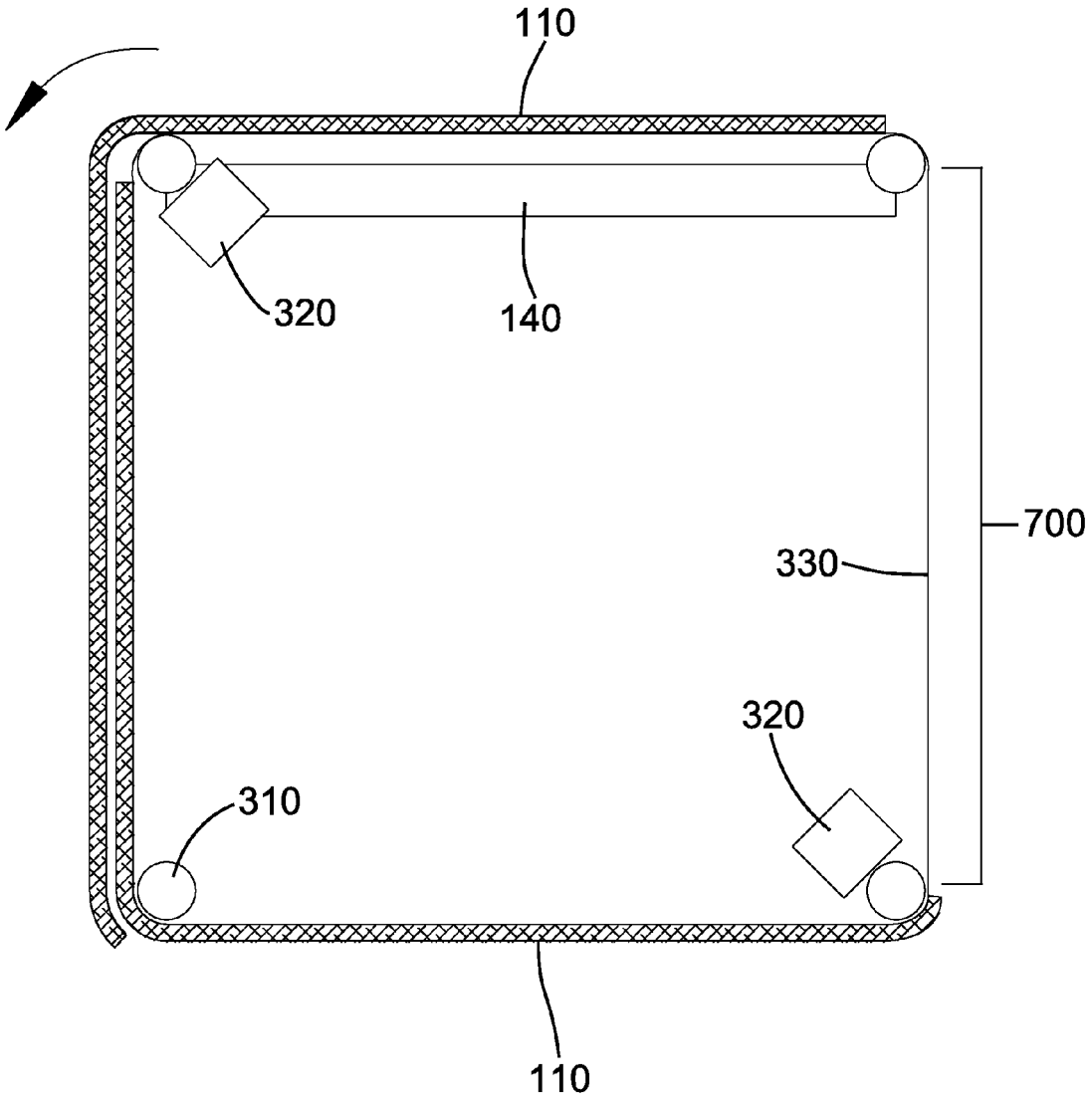
FIG. 7D depicts a top view of one embodiment of an elevator car, wherein at least one elevator door opens to expose door openings on three sides of the elevator, and a right side elevator door opening.

FIG. 7B, FIG. 7C, and FIG. 7D depict methods for opening the at least one elevator door 110 in an embodiment of an elevator car 100, wherein the at least one elevator door 110 opens to expose door openings 700 on three sides of the elevator car 100. When the motor 320 of at least one pulley system 120 is engaged, a belt 330 of the at least one pulley system 120 revolves around a pulley 310 of the at least one pulley system 120, along a set of tracks 300, which extend around the perimeter of the elevator car 100. At least one elevator door 110 that is attached to the belt 330 moves in the direction that the pulley 310 rotates. In one embodiment, as the at least one elevator door 110 moves, the at least one elevator door 110 is not folded or bunched or constricted. The at least one elevator door 110 retains its original shape, stretched loosely but fully, so the at least one elevator door 110 overlaps at least one adjacent wall 140 of the elevator car 100. In one embodiment, the at least one elevator door 110 overlaps at least one adjacent wall 140 of the elevator car 100 and at least one other elevator door 110, which is attached to a separate pulley system 120. At least one door opening 700 is exposed, allowing ingress to and egress from the elevator. The at least one elevator door 110 can travel either direction, left or right. In a preferred embodiment, the elevator car 100, with three door openings 700, comprises four pulley systems 120, two on top and two on bottom, and two elevator doors 110, each in the shape and size of two sides of the elevator car 100, and each attached to one pulley system 120 on top and one pulley system 120 on the bottom. FIG. 7B depicts a preferred embodiment of the elevator car 100 with three door openings 700, and a front elevator door 110 opening in the manner described above. FIG. 7C depicts a preferred embodiment of the elevator car 100 with three door openings 700, and a left side elevator door 110 opening in the manner described above. FIG. 7D depicts a preferred embodiment of the elevator car 100 with three door openings 700, and a right side elevator door 110 opening in the manner described above.

Figure 8A:
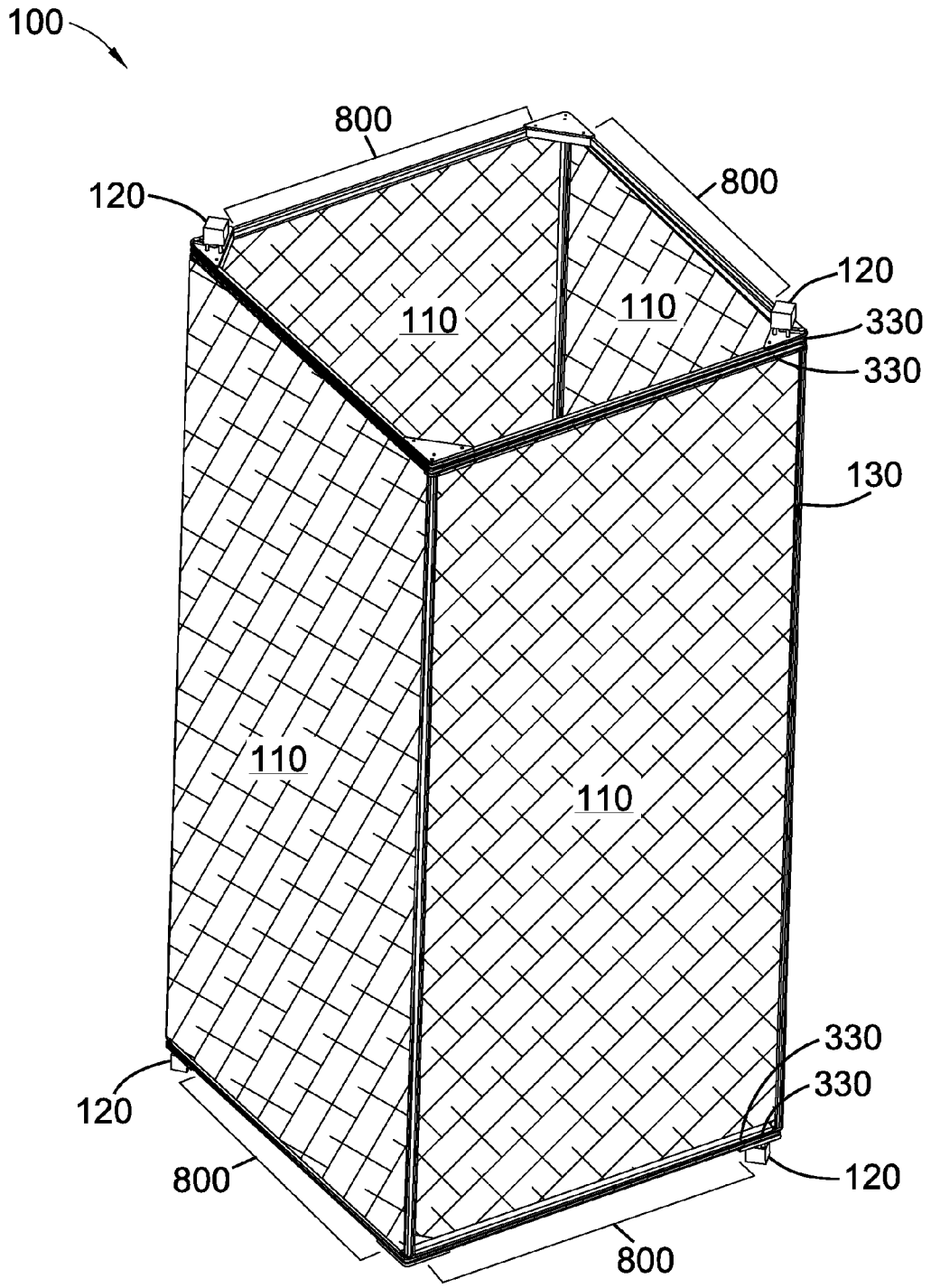
FIG. 8A depicts a perspective view of one embodiment of an elevator car, wherein the at least one elevator door opens to expose door openings on four sides of the elevator car.

FIG. 8A depicts one embodiment of an elevator car 100, wherein the at least one elevator door 110 opens to expose door openings 800 on four sides of the elevator car 100. The elevator car 100 comprises a frame 130 and a door system, comprising at least one elevator door 110 and at least one pulley system 120. In a preferred embodiment, the door system comprises two elevator doors 110, each in the shape and size of two sides of the elevator car 100 and extending over two sides. In another embodiment, there are four elevator doors 110, each in the shape and size of one side of the elevator car 100. However, this embodiment is not preferred because four pulley systems 120 would be required when the same work could be done by only two. The at least one elevator door 110 covers the four door openings 800. In a preferred embodiment, there are two pulley systems 120 attached on top and two pulley systems 120 attached on the bottom of the frame 130. In a preferred embodiment, one elevator door 110, in the shape and size of two sides of the elevator car 100, is attached between belts 330 of a pulley system 120 that is attached on the top and a pulley system 120 that is attached on the bottom of the frame 130, and a second elevator door 110 in the shape and size of two sides of the elevator car 100 is attached between belts 330 of a second pulley system 120 that is attached on the top and a second pulley system 120 that is attached on the bottom of the frame 130. In this embodiment, the elevator car 100 also comprises a ceiling (which is not shown so that the inside of the elevator car can be seen). There are no walls. In a preferred embodiment, the elevator car 100 has no floor. Rather, the floorless elevator car 100 is secured with connectors to a separate elevator platform.

Figure 8B:
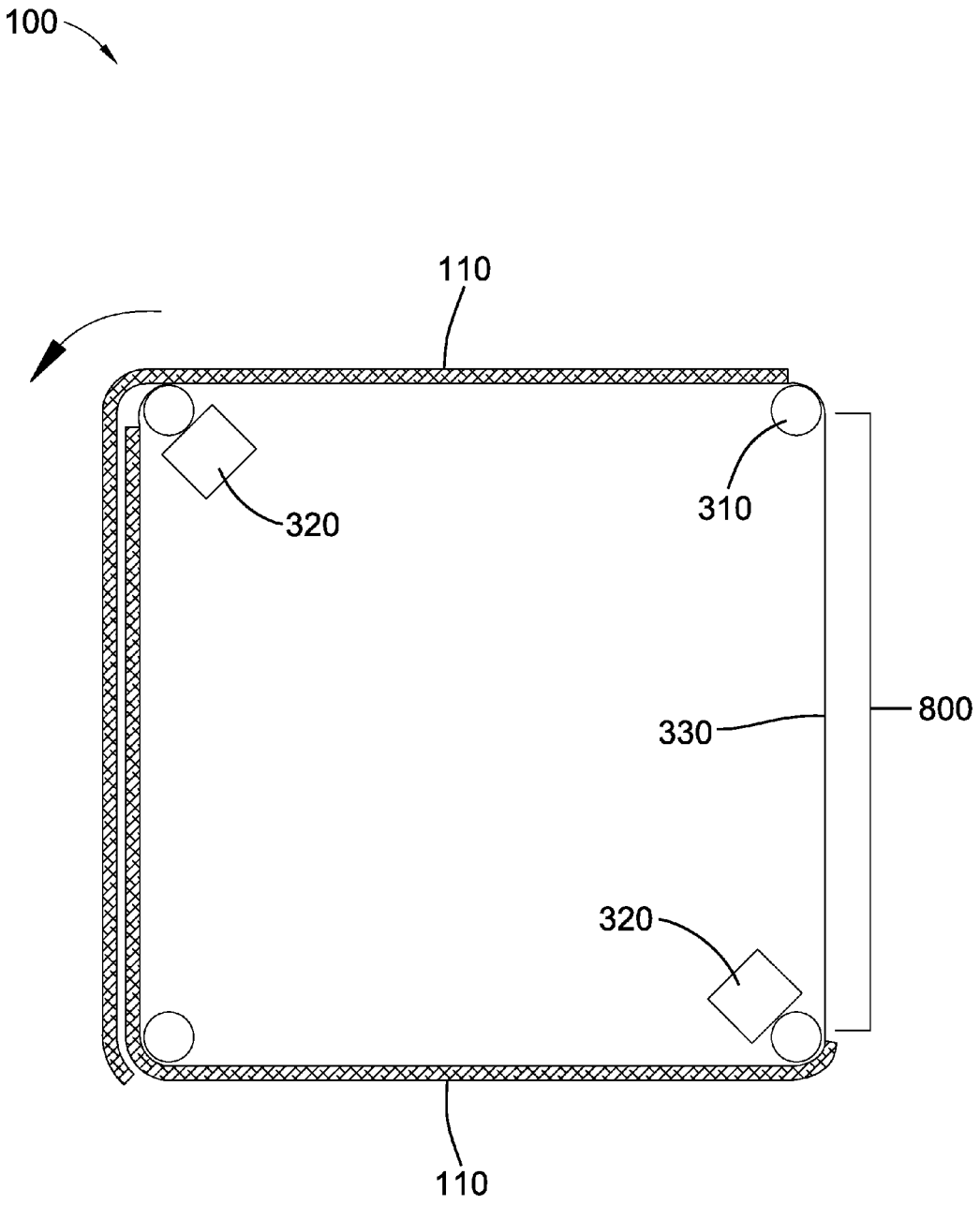
FIG. 8B depicts a top view of the method for opening the at least one elevator door in an embodiment of an elevator car, wherein the at least one elevator door opens to expose door openings on four sides of the elevator car.

FIG. 8B depicts the method for opening the at least one elevator door 110 in an embodiment of an elevator car 100, wherein the at least one elevator door 110 opens to expose door openings 800 on four sides of the elevator car 100. When the motor 320 of at least one pulley system 120 is engaged, a belt 330 of the at least one pulley system 120 revolves around a pulley 310 of the at least one pulley system 120, along a set of tracks 300, which extend around the perimeter of the elevator car 100. At least one elevator door 110 that is attached to the belt 330 moves in the direction that the pulley 310 rotates. In one embodiment, as the at least one elevator door 110 moves, the at least one elevator door 110 is not folded or bunched or constricted. The elevator door 110 retains its original shape, stretched loosely but fully, so the elevator door 110 overlaps on the outside an adjacent elevator door 110 of the elevator car 100. At least one door opening 800 is exposed, allowing ingress to and egress from the elevator. In a preferred embodiment, the elevator car 100, with four door openings 800, comprises four pulley systems 120 and two elevator doors 110, each in the shape and size of two sides of the elevator car 100. The two elevator doors 110 can travel either direction, left or right, such that at least one of each of four door openings 800 can be exposed in turn. If desired, two adjacent door openings 800 can be exposed.

Figure 9:
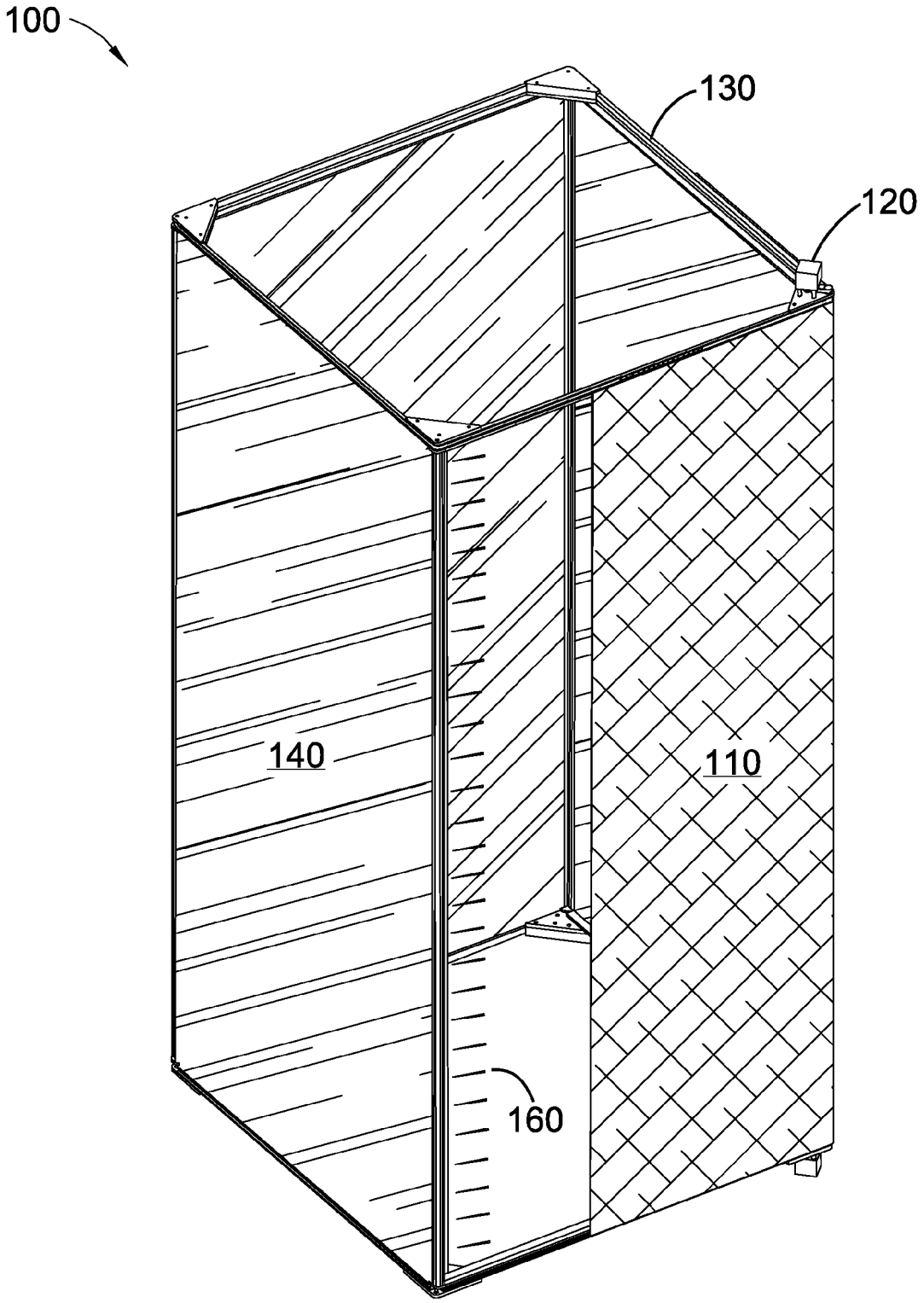
FIG. 9 depicts a perspective view of one embodiment of an elevator car comprising at least one light curtain.

In one embodiment, the elevator car 100 further comprises at least one light curtain 160. FIG. 9 depicts one embodiment of an elevator car 100 comprising at least one light curtain 160. Each light curtain 160 is positioned just inside an elevator door 110. The at least one light curtain 160 creates a safety barrier. In one embodiment, the at least one light curtain 160 transmits signals to an elevator control system. If the at least one light curtain 160 is triggered when the elevator is moving, the at least one light curtain 160 will transmit a signal to an elevator control system that will cause the elevator to stop. This increases safety by preventing the limbs of the elevator passengers from breaking through the elevator door 110 barrier and extending into the elevator shaft when the elevator is moving. If the at least one light curtain 160 is triggered when the elevator is stopped, the at least one light curtain 160 will transmit a signal to an elevator control system that will cause an elevator door 110 to open. This prevents anyone from getting closed inside an elevator door 110. In one embodiment, the elevator control system is a voice control system. In other embodiments, the elevator control system is a projected image of buttons or a network that can be accessed through a personalized hand-held device.

The invention claimed is:

1. An elevator car comprising:

a frame secured atop a bottom-driven elevator platform, the frame comprising interconnected vertical supports and horizontal supports, the vertical supports defining car walls, the horizontal supports defining a car floor and a car ceiling; and a door system comprising:

at least one pulley system, the at least one pulley system comprising a belt, at least one pulley, and a set of tracks attached to the horizontal supports and extending around an entire perimeter of the car, wherein the belt extends around the entire perimeter of the car; and at least one elevator door, the at least one elevator door comprising a pliable material, and the at least one elevator door attached to the belt, such that the at least one elevator door rotates horizontally around the frame with the belt when the at least one pulley system is engaged, thereby exposing at least one door opening.

2. The elevator car of claim 1, wherein the at least one elevator door rotates to expose a door opening on one side of the elevator car.

3. The elevator of claim 1, wherein the at least one elevator door rotates to expose door openings on two sides of the elevator car.

4. The elevator of claim 1, wherein the at least one elevator door rotates to expose door openings on two adjacent sides of the elevator car.

5. The elevator of claim 1, wherein the at the at least one elevator door opens to expose door openings on three sides of the elevator car.

6. The elevator of claim 1, wherein the at least one elevator door opens to expose door openings on four sides of the elevator car.

7. The elevator car of claim 1, wherein the at least one elevator door extends completely around two sides of the elevator car.

8. The elevator car of claim 1, wherein the frame further comprises a ceiling, a floor, and/or at least one wall.

9. The elevator car of claim 8, wherein the ceiling, the floor, and the at least one wall comprise plastic.

10. The elevator car of claim 8, wherein the ceiling, the floor, and the at least one wall comprise one of a group of lightweight metals consisting of aluminum, magnesium, titanium, beryllium alloys, or combinations thereof.

11. The elevator car of claim 8, wherein the ceiling, the floor, and the at least one wall comprise optically transparent or semi-optically transparent materials.

12. The elevator car of claim 1, wherein the door system comprises two pulley systems, and one pulley system is attached to the horizontal supports on a top edge of the frame and one pulley system is attached to the horizontal supports on a bottom edge of the frame.

13. The elevator car of claim 1, wherein the frame comprises one or more lightweight materials selected from the group consisting of aluminum, magnesium, titanium, beryllium alloys, or combinations thereof.

14. The elevator car of claim 1, wherein the pliable material comprises ballistic nylon, another synthetic fabric, and/or vinyl.

15. The elevator car of claim 1, wherein the pliable material comprises one of a group consisting of woven, non-woven, knitted, and netting fabrics.

16. The elevator car of claim 1, further comprising at least one light curtain.

17. The elevator car of claim 16, wherein the at least one light curtain transmits signals to an elevator control system.

18. The elevator car of claim 17, wherein the elevator control system is voice controlled.

19. The elevator car of claim 1, wherein the at least one pulley system comprises a motor, and the motor receives signals from an elevator control system.

20. The elevator car of claim 1, wherein the frame comprises a rectangular prismatic configuration.

* * * * *